United States Patent [19]

Maier et al.

[11] Patent Number: 4,966,331

[45] Date of Patent: Oct. 30, 1990

[54] STIRRED BALL MILL FOR GRINDING PIGMENTS

[75] Inventors: Manfred Maier, Ludwigshafen; Manfred Mielke, Heidelberg; Peter Hauser, Limburgerhof, all of Fed. Rep. of Germany

[73] Assignee: BASF Aktiengesellschaft, Ludwigshafen, Fed. Rep. of Germany

[21] Appl. No.: 325,114

[22] Filed: Mar. 20, 1989

Related U.S. Application Data

[63] Continuation of Ser. No. 130,960, Dec. 10, 1987, abandoned.

[30] Foreign Application Priority Data

Dec. 11, 1986 [DE] Fed. Rep. of Germany ..... 3642330

[51] Int. Cl.[5] ..... B02C 17/16

[52] U.S. Cl. ..... 241/172; 366/279

[58] Field of Search ..... 366/279, 65, 309; 241/171, 172, 65, 66, 67, 69, 46.17

[56] References Cited

U.S. PATENT DOCUMENTS

| | | | |
|---|---|---|---|
| 639,406 | 12/1899 | Kreiss | 241/172 X |
| 2,019,454 | 10/1935 | Larsen | 241/172 X |
| 2,592,994 | 4/1952 | Ahlmann . | |
| 3,075,710 | 1/1963 | Feld et al. . | |
| 3,329,348 | 7/1967 | Pootmans | 241/172 X |
| 3,339,896 | 9/1967 | McKibben | 241/172 X |
| 4,236,677 | 12/1980 | Lodige et al. | 241/172 |
| 4,730,789 | 3/1988 | Geiger | 241/172 X |

FOREIGN PATENT DOCUMENTS

| | | | |
|---|---|---|---|
| 2330098 | 1/1975 | Fed. Rep. of Germany . | |
| 402660 | 10/1909 | France | 241/172 |
| 289073 | 2/1962 | France | 241/172 |
| 2229463 | 12/1974 | France | 241/172 |
| 421670 | 4/1967 | Switzerland . | |
| 566628 | 8/1977 | U.S.S.R. | 241/172 |
| 778789 | 11/1980 | U.S.S.R. | 241/172 |
| 638328 | 6/1950 | United Kingdom | 241/46.17 |

*Primary Examiner*—Mark Rosenbaum
*Attorney, Agent, or Firm*—Keil & Weinkauf

[57] ABSTRACT

A stationary container equipped with an inlet and an outlet and filled with grinding medium encloses a drivable, rotatably mounted stirrer whose active surfaces are formed as impellers for the grinding medium which are closely adjacent to the inner surface of the container.

3 Claims, 4 Drawing Sheets

STIRRED BALL MILL FOR GRINDING PIGMENTS

Figure 1:
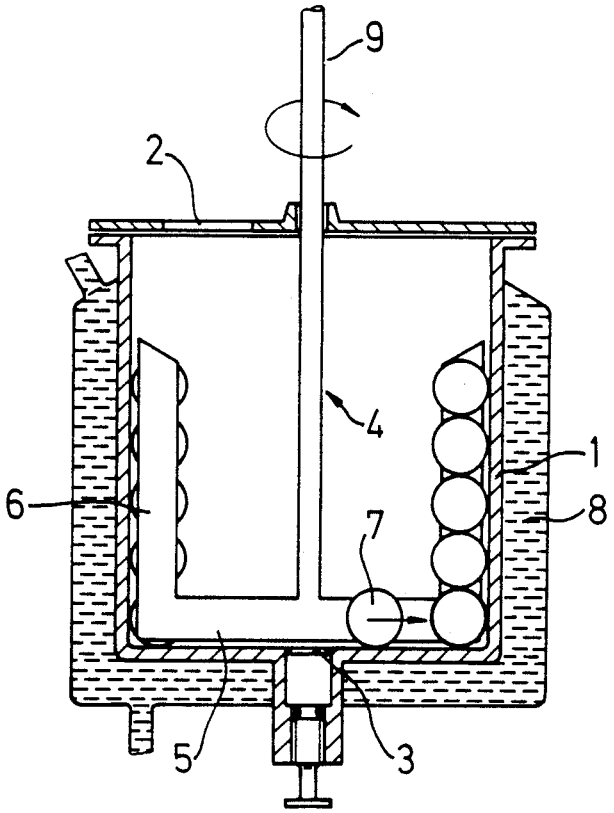

This application is a continuation of application Ser. No. 07/130,960, filed on Dec. 10, 1987 now abandoned.

The present invention relates to a stirred ball mill for grinding, in particular dry grinding, pigments, comprising a cylindrical container containing grinding medium and equipped with an inlet for the mill base to be ground and an outlet for the ground mill base, and a drivable stirrer arranged in the axis of the container.

It is known that, by grinding, crude pigment products can be comminuted and, in some instances, converted into a different crystal modification.

The ground products thus prepared are then frequently subjected to an additional solvent treatment or incorporated in solvent-containing binder systems for use in printing inks, surface coatings and plastics. With numerous crude pigment products it is only by grinding that it is possible to obtain pigmentary qualities, ie. particles within the range of 1 μm or smaller.

There are a large number of industrial scale mills in existence for grinding crude pigment products, such as vibrating, drum and tube mills. These mills are operated using high grinding medium charges from 50% to 90% of mill volume capacity, so that the weight of grinding medium to be agitated in the grinding process is from 10 to 40 times that of the mill base.

In addition there are planetary and centrifugal ball mills used in the laboratory for smaller test samples.

With planetary and centrifugal ball mills it is additionally necessary to set the outer housing of the milling vessel, which for cooling purposes can have a double shell design, into rapid rotating motions or long amplitude swings by means of eccentric arrangements. The rapid movement of large inertial masses imposes substantial capacity restraints owing to the loads and forces on the bearings and drive system.

All existing mills further have the substantial disadvantage that the grinding energy input goes predominantly to heat up the grinding medium and the mill base and only to a small extent performs useful size reduction work on the crude pigment product.

The inevitable heating effect on the mill base is frequently antagonistic to the reduction in size, or phase conversion, so that at excessively high temperatures the mill base undergoes recrystallization and size enlargement. Elevated grind temperatures limit the efficiency of the mill and hence its yield. Particularly with the grinding of organic pigments it is frequently desirable to grind the mill base within defined temperature ranges and to impose an upper temperature limit so as to avoid damaging the product.

In addition, existing mills necessitate substantial investment owing to their method of construction and operation, ie. the movement of large masses and temperature control.

It is an object of the present invention to develop an apparatus for grinding, in particular dry grinding, pigments which avoids these disadvantages and is superior to existing grinding apparatus in efficiency and the quality of ground mill base.

We have found that this object is achieved with a stirred ball mill of the type described at the beginning, wherein the active surfaces of the stirrer are constructed in the form of impellers for the grinding medium which are closely adjacent to the inner surface of the container.

Figure 2A:
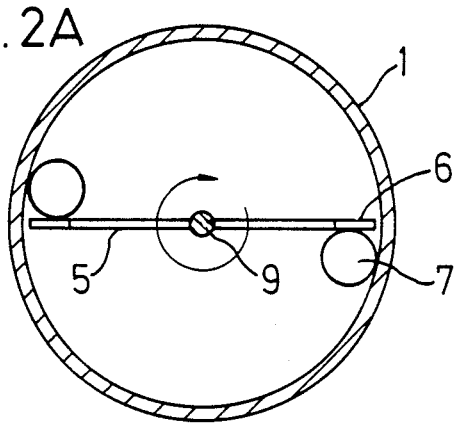
Figure 2B:
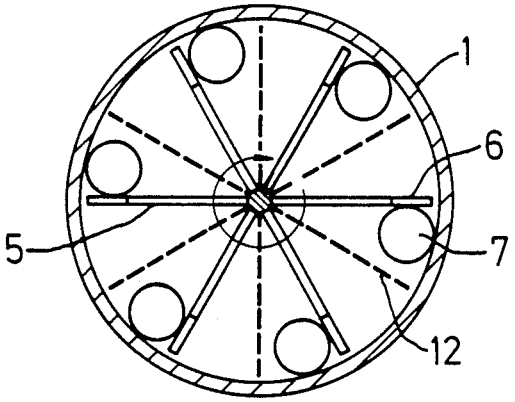
Figure 2C:
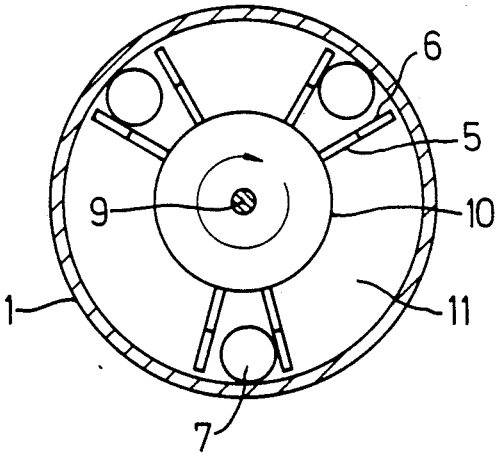
Figure 3:
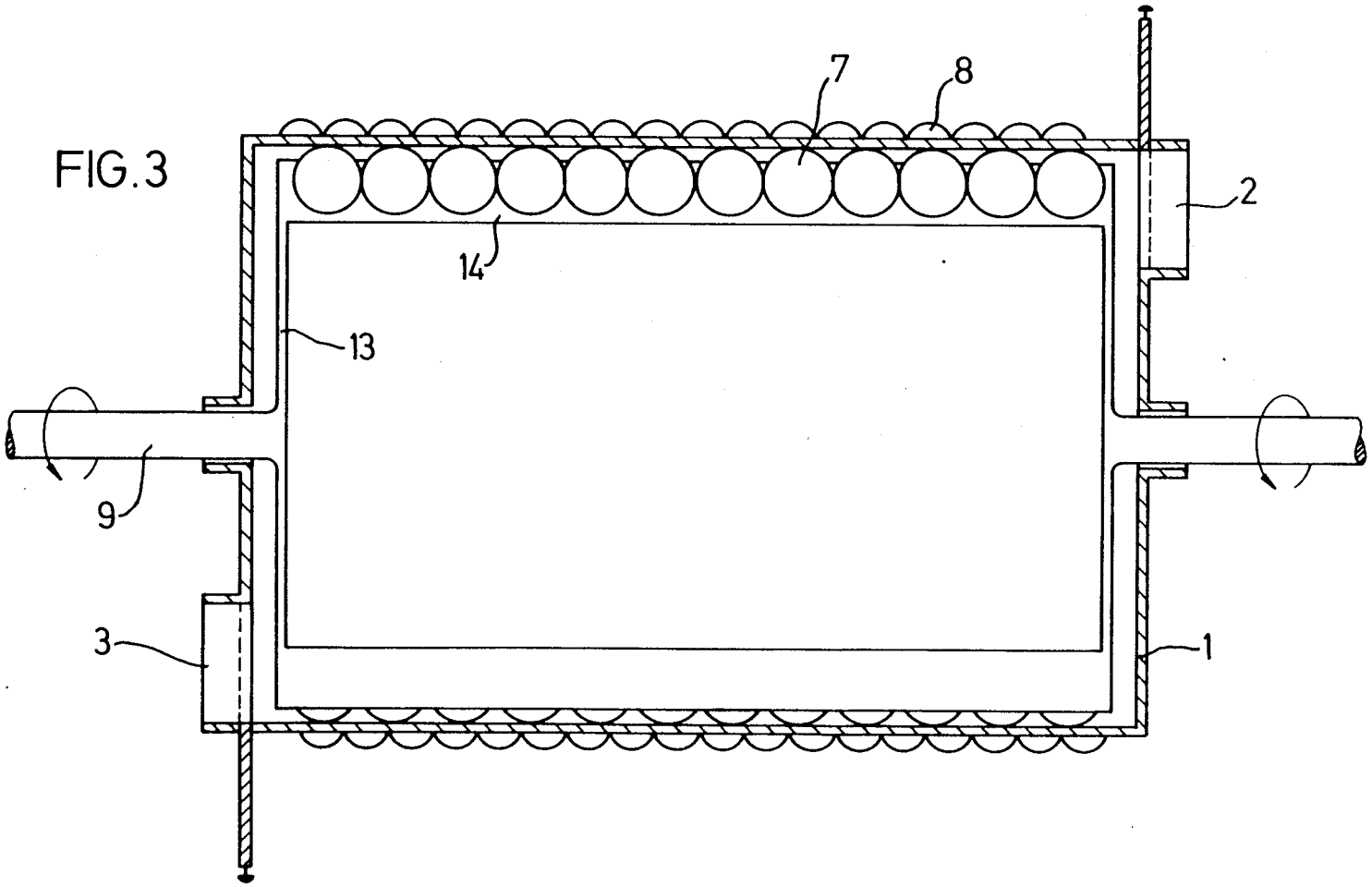
Figure 4:
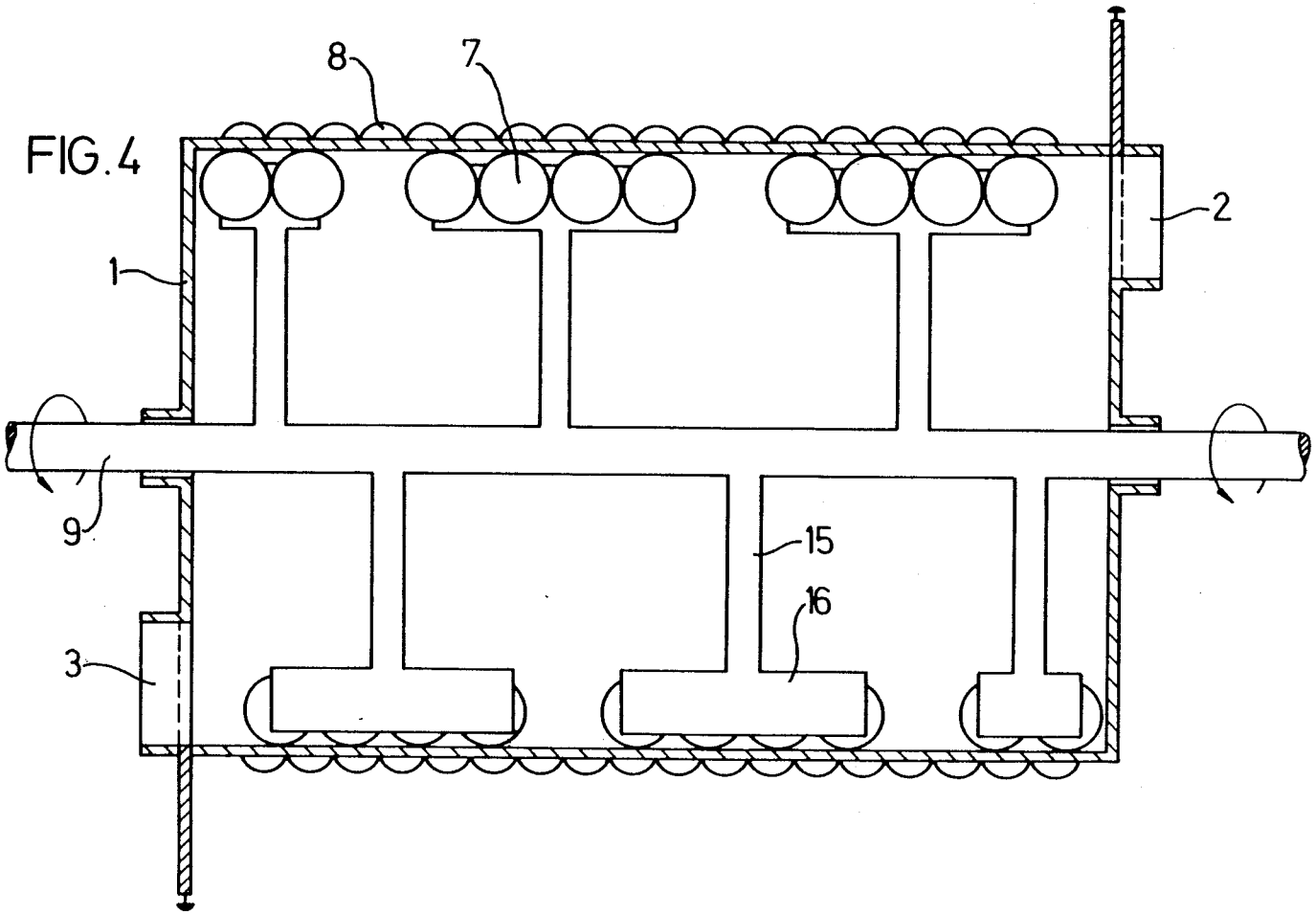

In what follows, the invention is described in detail by reference to several illustrative embodiments of the stirred ball mill of the invention depicted schematically in the drawing, where FIG. 1 shows a vertically arranged stirred ball mill in longitudinal section, having stirring surfaces attached to arms;

FIGS. 2 A–C show various embodiments of stirrers in cross-section;

FIG. 3 shows a horizontally arranged stirred ball mill in longitudinal section, having a cagelike stirred drum; and FIG. 4 shows a horizontally arranged stirred ball mill in longitudinal section, having stirring elements attached to arms in a staggered arrangement.

The stirred ball mill consists essentially of a stationary cylindrical container 1 (FIG. 1) which is equipped with an inlet 2 for the mill base to be ground and with a sealable outlet 3 for the ground mill base, and a motor-drivable drivable stirrer 4. On the stirrer 4 are arms 5 to which are attached stirring surfaces 6 in the form of sheet-like webs which extend closely along the inner surface of the container, so that grinding medium balls 7 present therein are impelled by the rotating stirring surfaces and moved along the inner surface. As will be noted from the drawing, the spacing between the webs 6 and the inside of the container wall is small compared with the diameter of the balls. As a result it is possible, with the help of heating and/or cooling means 8 attached to the outer surfaces of container 1 to effect uninterrupted temperature control of the mill base and of the balls. The grinding takes place in the interstices between the balls and between the balls and the container wall. The heating and cooling means can for example take the form of pipe coils or a double shell with a gap in between for a heating or cooling medium to flow through, or, alternatively, conventional electric heating means.

FIGS. 2 A–C show in schematic diagrams various embodiments of stirrers in cross-section. The representation in FIG. 2 A corresponds to the mill shown in FIG. 1. The stirrer of FIG. 2 B has a plurality of stirring arms 5, 6, which can be disposed in a staggered arrangement along the stirrer shaft 9. By arranging a cylinder 10 coaxially on the stirrer shaft it is possible, as shown in FIG. 2 C, to construct the inner space of container 1 as an annular space 11. This has the advantage that the grinding space can also be temperature-controlled from the center if the stirrer shaft is hollow on the inside and provided with feed lines for temperature control fluids.

The drive of the stirrer is usually provided by a variable speed electric motor whereby the stirrer can gradually be accelerated from the stationary position to the desired final speed. In the course of this process of acceleration, the balls are moved by the centrifugal forces-from the floor of the container to the inner surface thereof and in the course of this motion even exert a grinding action on the mill base by rolling against one another. As the speed of rotation of the close clearance stirrer increases, some of the balls move upward along the inner surface, owing to mutual displacement in the case of a vertical disposition of the stirrer axis, together with mill base, so that an uninterrupted exchange of ground and unground product can take place. The balls themselves become uniformly distributed behind the individual stirrer arms, since the stirrer design according to the invention ensures that in the start-up phase of the mill the balls can roll over the individual stirrer arms at the container floor. This prevents imbalance when the mill is at speed, ie. when the balls are pushed along the inner surface by the individual arms of the stirrer.

However, it is also possible, if necessary, to attach two variable speed electric motors to the two ends of the stirrer shaft.

The stirred ball mill can also be operated in an inclined or horizontal attitude, in which case it is advantageous, although not absolutely necessary, to subdivide the inner space of the container by means of metal sieves or perforated plates 12 (FIG. 2 B) arranged radially on the stirrer shaft 9, into individual sectors into which the balls are introduced in accordance with the desired surface occupancy along the container wall.

In a further embodiment of the stirred ball mill, the stirrer comprises a cagelike drum 13 (FIG. 3) which has, at the circumference, axially parallel sheetlike webs 14 running closely along the container wall.

In a further embodiment of the stirred ball mill (FIG. 4), the stirrer has a plurality of arms 15 which are disposed in a staggered arrangement along the stirrer shaft 9 and the container circumference and have paddlelike stirrer elements 16 whose surfaces are in correspondence with the gaps-in between or are in partial overlap.

As the stirrer speed increases, the balls are transported along the container wall by these centrifugal forces and by means of the paddles even when the mill is operated in a horizontal attitude, so that uniform thorough grinding without imbalance phenomena is ensured.

For the purposes of the present invention, grinding medium balls are for example spherical or cylindrical shapes whose diameter is not less than twice the distance of the stirrer blade from the inner surface of the container. Advantageous diameter ranges are from 5 to 80 mm, preferably from 10 to 40 mm.

The advantages of the stirred ball mill according to the invention are that the stirrer only moves the balls together with the mill base while the outer temperature controllable cylindrical shell remains stationary, so that the actual grinding always takes place at the temperature controllable/coolable wall, which prevents overheating of the mill base.

A further advantage is that the ball charge is restricted to partially or completely covering the outer cylinder surface, so that, unlike prior art mills, the volume loading with balls need not be high. This leads to advantageous weight ratios of crude pigment product: grinding medium, for example from 1:6 to 3:1. In this connection we have found, surprisingly, that, as the diameter of the apparatus increases, for the same phase conversion rate of a crystal modification the amount of grinding medium required decreases relative to the amount of mill base; that is, mill efficiency increases overproportionally with increasing ball numbers. In the mill according to the invention, volume utilization is higher than in existing apparatus, enlargement of total mill capacity presenting fewer technical problems than in the case of centrifugal mills which move together with the container.

Owing to the fact that the balls are subjected to forced movement, problems with caking of mill-base to the wall of the container are easier to detect and overcome than with balls agitated by inertia only, which are more prone to caking and consequent loss of effectiveness.

Since the mill base is frequently sensitive to rises in temperature, the mill according to the invention makes it possible, by enlarging the diameter and/or length of the container, to obtain a large cooling and heat control surface required for production scale systems, permitting the mill base to be ground in large amounts (up to several hundred kg) in one mill while keeping a substantially constant product temperature.

A further advantage is that products which are prone to caking and which, in existing mills, can only be ground in the presence of salt, thereby reducing the throughput of mill base through these mills accordingly, can, owing to the provision of external cooling, nonetheless be ground with a high grinding energy input, ie. high acceleration of the balls. The additional removal of this salt load with its environmental disadvantages is consequently much less of a problem, or totally avoided.

It is a further advantage that, on completion of dry grinding, the ground products are crystallizable, by treatment with solvents and if desired auxiliary substances, into completed pigments in the same mill, the presence of the balls helping to avoid overcrystallization of the pigments owing to the shear forces present.

A further, surprising difference from production scale mills hitherto used in industry is that the mill according to the invention permits spontaneous grinding of certain high grade crystal modifications which are otherwise obtainable by grinding only indirectly, eg. the very reddish crystal modification of $\epsilon$-copper phthalocyanine from the $\alpha$- or $\beta$-modification as starting substance.

In addition to the technical advantages mentioned there is a substantial economic advantage owing to the relatively simple manner of construction and high level of volume utilization.

We claim:

1. A stirred ball mill for grinding, in particular dry grinding, pigments, comprising a stationary cylindrical container containing grinding balls and equipped with an inlet for the material to be ground and an outlet for the ground material, and a drivable stirrer arranged for rotation about the axis of the container, wherein the active surfaces of the stirrer are in the form of webs carried at the ends of radial arms, said webs lying in planes including said axis and being thin compared to their extent in a direction radially of said axis, in which direction they extend in closely spaced, non-touching relationship to, the inner wall of said container so as to act as impellers for the grinding balls, the spacing of said webs from said inner wall being small compared with the diameter of said balls;

wherein the stirrer has a shaft; and wherein said radial arms, together with said webs, are in the form of a plurality of paddlelike stirrer elements which are disposed along the stirrer shaft and the container circumference in a staggered arrangement and whose stirring surfaces are in an overlap arrangement.

2. A stirred ball mill for grinding, in particular dry grinding, pigments, comprising a stationary cylindrical container containing grinding balls and equipped with an inlet for the material to be ground and an outlet for the ground material, and a drivable stirrer arranged for rotation about the axis of the container, wherein the active surfaces of the stirrer are in the form of webs carried at the ends of radial arms, said webs lying in planes including said axis and being thin compared to their extent in a direction radially of said axis, in which direction they extend in closely spaced, non-touching relationship to, the inner wall of said container so as to act as impellers for the grinding balls, the spacing of said webs from said inner wall being small compared with the diameter of said balls; and wherein the stirrer is divided in sectors by sieves or perforated sheets which extend radially in staggered relationship to said radial arms.

3. A stirred ball mill for grinding, in particular dry grinding, pigments, comprising a stationary cylindrical container containing grinding balls and equipped with an inlet for the material to be ground and an outlet for the ground material, and a drivable stirrer arranged for rotation about the axis of the container, wherein the active surfaces of the stirrer are in the form of webs carried at the ends of radial arms, said webs lying in planes including said axis and being thin compared to their extent in a direction radially of said axis, in which direction they extend in closely spaced, non-touching relationship to, the inner wall of said container so as to act as impellers for the grinding balls, the spacing of said webs from said inner wall being small compared with the diameter of said balls;

wherein said cylindrical container has a vertical axis and said stirrer is disposed for rotation about said vertical axis; and wherein said radial arms extend adjacent to the bottom of the container, and, themselves, are in the form of webs lying, respectively, in the same planes as the first-mentioned webs carried thereby, such that, in operation, the balls under centrifugal force are moved along said arms and then pushed upwardly along the first-mentioned webs.

* * * * *